United States Patent [19]

Cross

[11] 4,126,092

[45] Nov. 21, 1978

[54] METHOD OF CUTTING METAL ELEMENTS UNDERWATER AND A SHAPED EXPLOSIVE CHARGE DEVICE THEREFOR

[75] Inventor: Graham W. Cross, Saltcoats, Scotland

[73] Assignee: Imperial Chemical Industries Limited, London, England

[21] Appl. No.: 752,920

[22] Filed: Dec. 21, 1976

[30] Foreign Application Priority Data

Jan. 27, 1976 [GB] United Kingdom ..... 3068/76

[51] Int. Cl.[2] ..... F42B 3/08

[52] U.S. Cl. ..... 102/24 HC

[58] Field of Search ..... 102/24 HC

[56] References Cited

U.S. PATENT DOCUMENTS

| | | | |
|---|---|---|---|
| 2,797,892 | 7/1957 | Ryan | 102/24 HC |
| 3,248,072 | 4/1966 | Schimmel | 102/24 HC |
| 3,311,056 | 3/1967 | Noddin | 102/27 R |
| 3,374,737 | 3/1968 | Pike | 102/24 HC |
| 3,658,006 | 4/1972 | Nistler | 102/24 HC |
| 3,855,929 | 12/1974 | Ridgeway | 102/24 HC |

FOREIGN PATENT DOCUMENTS

| | | | |
|---|---|---|---|
| 1,463,810 | 11/1966 | France | 102/24 HC |

OTHER PUBLICATIONS

The Condensed Chemical Dictionary, 8th Ed., Van Nostrend Reinhold Co., p. 713.

*Primary Examiner*—Verlin R. Pendegrass

*Attorney, Agent, or Firm*—Cushman, Darby & Cushman

[57] ABSTRACT

Improved methods of cutting metal elements underwater wherein a shaped explosive charge cutting device has a quantity of externally disposed foam which reduces secondary damage to the cut metal edges.

8 Claims, 3 Drawing Figures

METHOD OF CUTTING METAL ELEMENTS UNDERWATER AND A SHAPED EXPLOSIVE CHARGE DEVICE THEREFOR

This invention relates to an improved method of cutting metal elements underwater using shaped explosive charges and to the shaped explosive charge devices and casings used in the said method.

Shaped explosive charges are designed to produce a focussed shockwave of great penetrating power directed outwardly along the central axis of an outwardly divergent cavity in one face of the charge. The cavity is usually conical, frusto-conical or sphero-conical. The cavity cross-section parallel to the base may be circular but, in elongated shaped charges used for linear and curvilinear cutters it will be rectangular or other elongate form. The explosive composition is usually disposed symmetrically with respect to the cavity axis. In use the shaped charge is placed with the base of the cavity facing towards the target surface and at an optimum distance for maximum cutting effect. Usually the cavity is lined with metal to enhance the penetrating power.

The housing of the shaped charge device generally extends beyond the base of the cavity of the explosive charge to provide the required stand-off, and for underwater charges the cavity and stand-off volume are sealed to exclude water. Thus underwater shaped charge devices generally have a sealed charge casing divided into an explosive charge compartment and a stand-off compartment separated by a cavity liner presenting a concave surface within the stand-off compartment. Pipe cutters comprising curvilinear shaped explosive charges suitable for underwater use have now been described in United Kingdom Patent Specification No. 1,367,011.

It has been found that when shaped explosive charge devices are used to cut metal elements underwater the edges of the cut tend to be distorted and ragged. This effect becomes more pronounced with increasing depth of water and becomes excessive at depths greater than 200 feet. In order to eliminate or reduce such damage it has been proposed in Norwegian Patent Application No. 742,168 to provide an external expansion chamber for the gas released by the explosive charge. The expansion chamber is believed to be effective in reducing the strength of shock waves reaching the cut edges directly from the initial explosion and also as a result of subsequent oscillation of the gas bubble produced by the explosion, thereby reducing secondary damage to the cut edges subsequent to the initial cutting action. Preferably the expansion chamber was provided as a jacket disposed around the shaped explosive charge cutter and, in order to prevent collapse and consequent waterlogging of the expansion chamber, the jacket was required to be sufficiently strong to withstand the working pressure or the gas in the chamber was required to be at a sufficiently high pressure. The provision of a strong jacket adds substantially to the cost of the device and pressurising the chamber is complicated and time consuming.

It is an object of this invention to provide an improved method of reducing the secondary damage when metal elements are cut by shaped explosive charges underwater.

In accordance with the invention a metal element is cut underwater by means of a shaped explosive charge device having a quantity of foam disposed externally adjacent to the charge to reduce secondary damage to the cut edges of the metal element. The foam is preferably disposed as a layer overlying the external surface of the shaped charge housing, but it will be understood that the foam should not be present in the path of the focussed jet from the explosive to the target.

The foam may conveniently be in the form of a rigid foamed plastics material such as rigid polyurethane foam. A foam having a specific gravity of 0.25 to 0.3 (about 75 to 85% by volume of gas) is eminently suitable.

No external supporting structure is usually required for rigid closed cell foam used at depths of less than 400 feet. With open cell foams or foams used at great depths it is advantageous to protect the foam with a waterproof barrier, for example a thin metal jacket around the shaped charge device, the foam being advantageously formed in situ within the jacket.

The ratio of the thickness of the foam layer to the maximum width of the cavity of the shaped charge should preferably be in the range 0.5 to 5:1 and more preferably in the range 0.75 to 2.5:1.

From another aspect the invention consists in a casing for a shaped explosive charge device comprising a compartmented sealed housing providing a first compartment adapted to contain a shaped explosive charge having a hollow cavity and a second compartment adapted to provide stand-off space for the said shaped explosive charge, said compartments being separated by a liner for the said cavity, which liner presents a concave surface within the second compartment, and said housing having an adjacent externally disposed quantity of foam whereby secondary damage is reduced when said device is used to cut a metal element underwater.

The foam is advantageously a layer of rigid closed cell foam which may be attached to the external surface of the housing by means of a waterproof adhesive. In an alternative structure the foam may be enclosed in a waterproof barrier, for example a thin metal jacket, provided around the sealed housing.

The shaped explosive charge device of the invention comprises the aforedescribed casing containing a shaped explosive charge in the first compartment. The explosive is preferably a liquid explosive which may be filled into the device at the site of use. An explosive composed of two or more non-explosive components which may be mixed at the site to form the explosive composition is preferred.

The invention may be put into practice in various ways and in order to illustrate the invention further two embodiments of casings for shaped explosive charge devices for pipeline cutting will now be described, by way of Example, with reference to the accompanying drawings, in which FIG. 1 is a transverse cross-section of a casing for a curvilinear cutter of the invention on the line I—I of FIG. 3.

Figure 1:
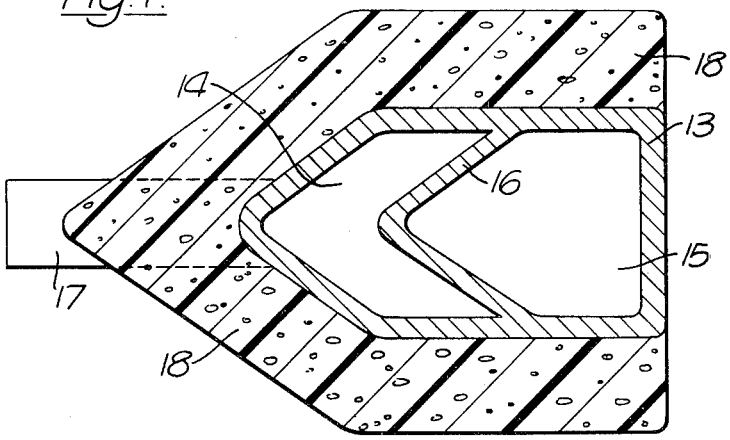
Figure 2:
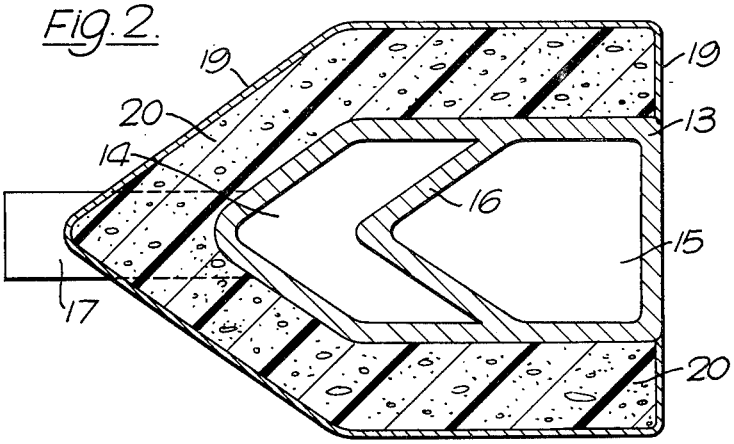
FIG. 2 is a transverse cross-section of an alternative form of casing for a curvilinear cutter.
Figure 3:
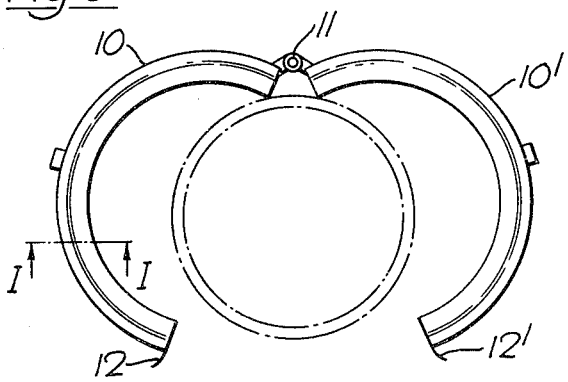
FIG. 3 is a plan view of the cutter of FIG. 1 being placed as a collar around a metal pipe (shown in broken lines).

The circular cutters shown in FIGS. 1 and 2 are constructed as two sealed semicircular half-sections 10 and 10' hinged together at hinge 11 as shown in FIG. 3. The half-sections are provided with latching hooks 12 and 12' for closing together when the half-sections are placed around the pipe.

The casings of FIGS. 1 and 2 (in which the same numerals are used to depict identical parts) include a housing 13 enclosing a sealed explosive compartment 14 of chevron-shaped cross-section, and a sealed stand-off compartment 15, separated by a liner wall 16 of V-shaped cross-section. The explosive compartment 14 on each half-section is provided with a filler pipe 17 through which the compartment may be filled with liquid explosive and an appropriate priming ignition means for the explosive may be inserted.

The housing 13 of FIG. 1 is overlaid with a layer of rigid closed-cell foamed synthetic plastics material 18 which is fixed to the housing with waterproof adhesive.

The housing 13 of FIG. 2 is surrounded by a thin jacket 19 and the space between the housing 13 and the jacket 19 is filled with a rigid foamed synthetic plastics material 20 which is foamed in situ and has a mainly open-cellular structure.

I claim:

1. A method of cutting a hollow metal cylindrical pipe underwater into two parts comprising placing an annular shaped explosive charge device on the surface of the pipe so as externally to embrace the pipe, and reducing secondary damage to the cut edges of the pipe by means of a sufficient quantity of foam disposed externally adjacent to the device out of the path of the focussed jet produced when the device is detonated.

2. A method as in claim 1 wherein the foam comprises rigid foamed plastics material.

3. A method as in claim 2 wherein the foam comprises rigid polyurethane foam.

4. A method as in claim 1 wherein the foam has a specific gravity of 0.25 to 0.3.

5. A method as in claim 1 wherein the foam is protected by a thin metal jacket around the shaped charge device.

6. A method as in claim 5 wherein the foam is formed in situ within the jacket.

7. A method as in claim 1 wherein the ratio of the thickness of the foam layer to the maximum width of the cavity of the shaped charge is in the range 0.5 to 5:1.

8. In a method of cutting a pipe under water by means of an annular, shaped explosive charge device placed around the pipe the improvement which comprises using as the shaped charge device a device comprising a compartmented sealed housing providing a first compartment containing a shaped explosive charge having a hollow cavity and a second compartment immediately adjacent the pipe so as to provide stand-off space for the shaped explosive charge, the compartments being separated by a liner for the cavity, which liner presents a concave surface within the second compartment, and a layer of rigid foamed plastics material of specific gravity 0.25 to 0.3 covering the external surfaces of the housing but not covering the surface facing the pipe, the thickness of the layer being from 0.5 to 5 times the maximum width of the cavity and sufficient to reduce secondary damage to the cut edges of the pipe when the explosive is detonated.

* * * * *